US005498352A

United States Patent [19]

Graham et al.

[11] Patent Number: 5,498,352

[45] Date of Patent: Mar. 12, 1996

[54] BEARING LUBRICATION MEANS HAVING WIDE TEMPERATURE UTILIZATION

[75] Inventors: Edgar E. Graham, Lyndhurst; Nelson H. Forster, Dayton, both of Ohio

[73] Assignee: Cleveland State University, Cleveland, Ohio

[21] Appl. No.: 341,633

[22] Filed: Nov. 17, 1994

[51] Int. Cl.[6] ..... C10M 105/74

[52] U.S. Cl. ..... 252/32.5; 252/12; 252/49.8

[58] Field of Search ..... 252/12, 32.5, 49.8; 184/6.22, 109

[56] References Cited

U.S. PATENT DOCUMENTS

| | | | |
|---|---|---|---|
| 2,841,244 | 7/1958 | Sorem | 184/109 |
| 2,952,335 | 9/1960 | Coit | 184/109 |
| 2,971,609 | 2/1961 | Sorem | 184/109 |
| 4,800,030 | 1/1989 | Kaneko et al. | 252/32.5 |
| 5,351,786 | 10/1994 | Graham | 184/6.22 |
| 5,382,374 | 1/1995 | Takemitsu et al. | 252/32.5 X |

*Primary Examiner*—Prince Willis, Jr.
*Assistant Examiner*—Cephia D. Toomer
*Attorney, Agent, or Firm*—John F. McDevitt

[57] ABSTRACT

Metal and/or ceramic bearing lubrication is provided over a utilization temperature range extending from about −50° C. up to at least 500° C. and higher with a blended mixture of a vaporizable and polymerizable aryl ester contained in a liquid alpha olefin oligomer. Vapor-phase polymerization of the aryl phosphate ester occurs during bearing operation to produce a polymer lubricating coating on at least one of the treated bearing surfaces.

9 Claims, 1 Drawing Sheet

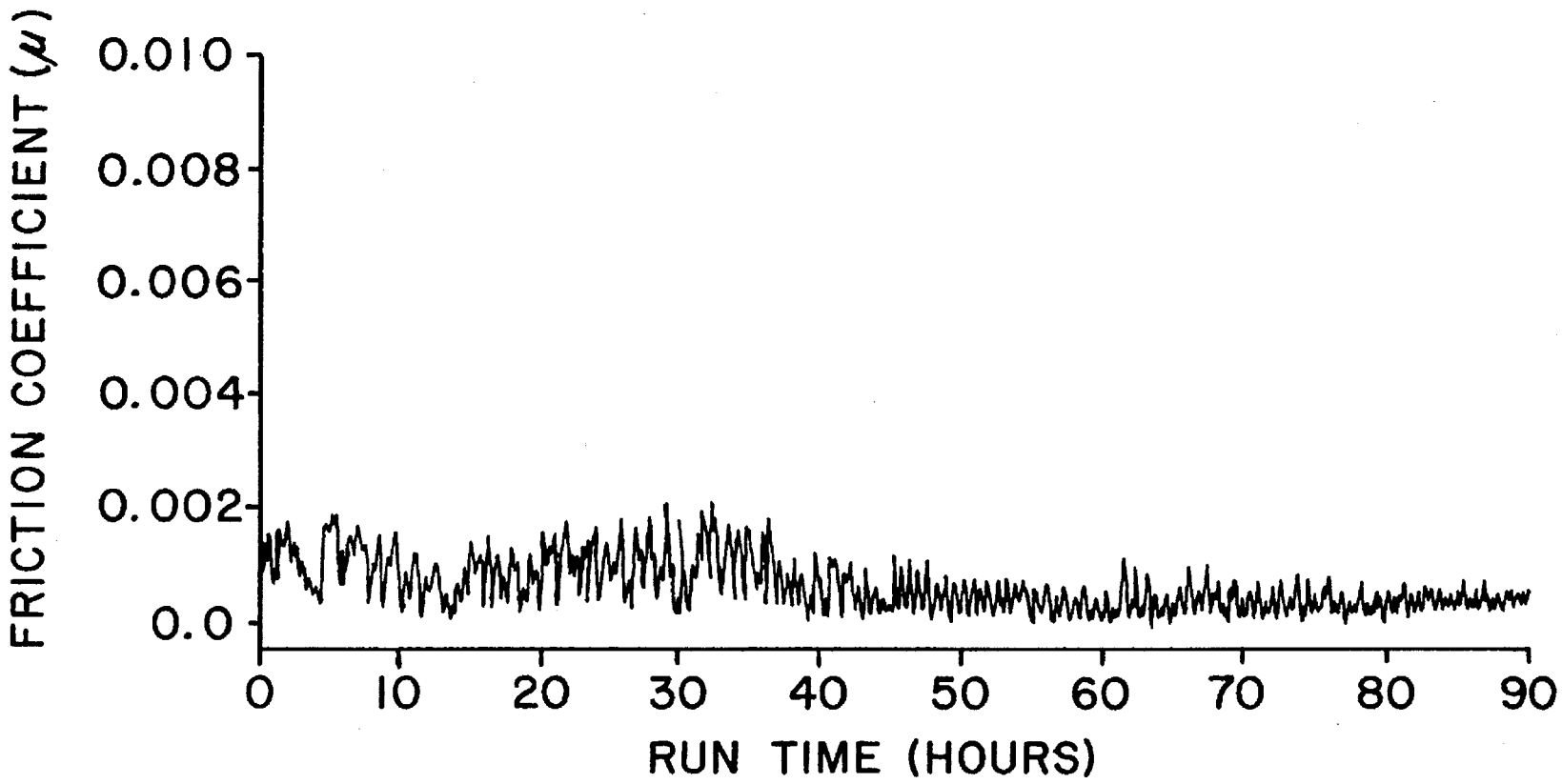
FRICTION COEFFICIENT (μ)
0.010
0.008
0.006
0.004
0.002
0.0
0
10
20
30
40
50
60
70
80
90
RUN TIME (HOURS)

BEARING LUBRICATION MEANS HAVING WIDE TEMPERATURE UTILIZATION

BACKGROUND OF THE INVENTION

This invention relates generally to lubrication means enabling both metal and/or ceramic bearing structures to resist mechanical wear when utilized in a temperature range extending from about −60° C. up to at least 500° C. and higher, and more particularly to employing an improved source of lubrication as the means for doing so. This invention was also made with Government support under contract F33615-90-C-2086 with the Department of the Air Force. The Government has certain rights in the invention.

Lubrication is a well recognized means to reduce friction and wear between bearing surfaces in dynamic physical contact. As such, a pair of load bearing surfaces having relative movement therebetween will be in rolling or sliding contact, as well as combinations thereof, which can include a wide variety of known structural articles such as journal bearings, piston rings, gears, cams and the like. Two major areas for which improved lubricants are needed for continued progress are metal-forming and transportation. Better metal-forming capabilities to minimize machining and grinding require lubrication techniques and lubricants that can be used effectively at temperatures approaching the melting points of the metals now employed. In transportation, one of the most productive areas for increasing energy efficiencies is often referred to as high temperature engines wherein temperatures range from 300° C. and above making the selection of lubricants and means for lubrication difficult. In other known high temperature engine applications, high bearing contact pressures to 300,000 psi are experienced making lubrication most difficult with existing lubrication systems. A known technique for lubrication at such high operational temperatures and pressures is the use of solid lubricants in the form of plasma sprayed coatings of metals and ceramics being employed.

A more recently discovered vapor-phase means of lubrication enables both metal and ceramic bearings to be operated satisfactorily at elevated temperatures of at least 300° C. and higher. For example, a tenacious polymer lubricating film is disclosed in U.S. Pat. No. 5,139,876 upon treating ceramic bearing surfaces during operation at elevated temperatures of at least 350° C. with vaporized organic reactants such as petroleum hydrocarbon compounds, mineral oils, various synthetic lubricants and to further include tricresyl phosphate (TCP) and triphenyl phosphate. In a still more recently issued U.S. Pat. No. 5,351,786, there is further disclosed lubrication means for such operation of the bearing devices with polymer lubricants formed in-situ upon vapor-phase deposition of various phosphazene compounds. For the vapor-phase lubrication of ceramic bearing devices in such manner, it has also been found that formation of the desired polymer lubricant can possibly be further enhanced by ancillary means. Accordingly, U.S. Pat. No. 5,139,876 discloses formation of the lubricating film after first treating the uncoated ceramic surface at elevated temperatures with activating metal ions comprising a transition metal element selected from the Periodic Table of Elements to include iron and tin. There is similarly disclosed in U.S. Pat. No. 5,163,757 a lubrication means for ceramic devices utilizing metal oxide lubricants formed during bearing operation. As therein disclosed, continuous lubrication of the ceramic bearing surfaces is provided with solid metal oxide lubricants formed in-situ with an oxidizable metal source located in physical proximity to the ceramic bearing surfaces being treated. A representative lubrication system enabling such mode of operation includes (a) support means causing the ceramic bearing surfaces to be maintained in dynamic physical contact, (b) an oxidizable metal source located in physical proximity to the support means, and (c) heating means for continuously heating the metal source while the ceramic bearing surfaces are being operated sufficient to provide the solid metal oxide lubricants. In one embodiment, the ceramic bearing means employs ceramic ball bearings supported within the ceramic race with a metal housing member enclosing the bearing structure. Utilizing oxidizable metal for construction of said housing member, including molybdenum and iron alloys, provides a suitable metal source in sufficient physical proximity to the bearing surfaces for satisfactory lubrication at the aforementioned operating conditions.

On the other hand, various bearing structures required to be operated satisfactorily at extremely low service temperatures, such as −60° C. and below, require lubrication means enabling the lubricant to be initially introduced as a liquid at such temperatures. For example, gas turbine engines, low heat rejection combustion engines and the like now employ bearings requiring lubrication when operated at such low environmental temperatures while further encountering elevated operating temperatures often exceeding 300° C. While synthetic lubricants such as liquid polyalphaolefins (PAO) are known to have service temperature ranges extending from −70° C. up to 200° C., none are found to undergo vapor-phase polymerization in order to experience the superior lubrication provided thereby at elevated temperature bearing operation.

It remains desirable, therefore, to provide lubrication of both metal and ceramic bearing means when utilized over a wider temperature range under various atmospheric conditions by still more effective means.

It is another object of the present invention to provide means for continuous lubrication of metal and ceramic bearing surfaces with a novel class of vapor-phase deposited polymer lubricants formed in-situ.

A still further object of the present invention is to provide a novel method for lubrication of metal and/or ceramic bearing surfaces at relatively low lubricant levels with vapor-phase deposited lubricants.

These and further objects of the present invention will become more apparent upon considering the following detailed description of the present invention.

SUMMARY OF THE INVENTION

It has now been discovered, surprisingly, that a more effective lubrication means can be provided for a mechanical apparatus employing at least one pair of moving bearing surfaces being operated in dynamic physical contact to resist mechanical wear of said bearing surfaces when utilized in a temperature range extending from about −60° C. up to at least 500° C. and higher. More particularly, both reduction of the friction coefficient and reduction of surface wear is now provided with a blended mixture containing a small but effective amount of a vaporizable and polymerizable aryl phosphate ester which is further suspended in a liquid alphaolefin oligomer as the starting lubricant composition. In a typical starting lubricant composition, both phosphate ester and oligomer constituents are miscible liquids with the phosphate ester constituent generally having a higher pour point than does the oligomer. Accordingly, relatively minor portions of the phosphate ester are employed in the starting lubricant mixture so that its pour point can be maintained at service temperatures as low as −60° C. and possibly even lower while further depending upon the particular material composition for the selected individual constituents in said starting mixture. Improved bearing operation results upon introducing the vaporized starting lubricant mixture to the operating bearing surfaces whereupon the phosphate ester constituent initiates polymerization in the vapor-phase to form a polymer lubricating film on one or more of the operating bearing surfaces. Both metal and ceramic bearing means can be operated in this manner with little wear occurring over relatively long time periods while such lubricants are being continuously applied. A temporary interruption of the present lubrication means during bearing operation and for time periods even exceeding thirty minutes was also found not to produce instantaneous bearing failure as distinct from using still other known vapor-phase formed polymer lubricants. Generally, the presently improved bearing lubrication requires (a) treating the bearing surfaces during operation at elevated temperatures of at least 250° C. with an atmospheric mixture containing the vaporized starting lubricant and (b) polymerizing the vaporized phosphate ester constituent in said starting lubricant in the vapor-phase while in contact with the operating bearing surfaces to form a vapor-deposited adherent polymer lubricating coating in-situ on at least one of the treated bearing surfaces. A typical mechanical apparatus employing the present lubrication means to resist wear occurring between a pair of moving bearing surfaces being operated in dynamic physical contact requires (a) support means causing the bearing surfaces to be maintained in dynamic contact, (b) a supply source of the starting liquid lubricant mixture, and (c) heating means to vaporize the liquid starting mixture in a suitable atmosphere causing the vaporized phosphate ester constituent to polymerize and form an adherent polymer lubricating coating on at least one of the bearing surfaces while being operated in dynamic physical contact at elevated temperatures of at least 250° C. In doing so, relatively low concentrations of the selected liquid starting lubricant, such as 0.02–0.3 volume percent, become vaporized in a suitable carrier gas, such as air, for deployment in lubricating amounts to the operating bearing surfaces. Satisfactory introduction of the vaporized mixture can be carried out at atmospheric conditions as well as various other operating conditions needed for satisfactory introduction. Subsequent polymerization of the introduced phosphate ester constituent in said mixture thereupon becomes initiated in the vapor-phase to produce an adherent solid polymer lubricating coating on the treated bearing surfaces when examined at ambient conditions. For example, solid polymer lubricants produced in such manner were found to have molecular weights of at least 30,000. Since formation of the desired phosphate ester polymer coating on a ceramic bearing member can also possibly be enhanced in accordance with the ancillary means described in the previously identified U.S. Pat. Nos. 5,139,876 and 5,163,757, the entire contents of both mentioned patents are hereby specifically incorporated by reference into the present application.

Suitable phosphate ester starting materials for employment in accordance with the present invention can be selected from the class of aryl phosphate esters to include isopropyl phenyl phosphates (IPPP) and t-butyl phenyl phosphates (TBPP) as well as tricresyl phosphates, triphenyl phosphates, mixed cresyl-xylenyl phosphates and cresyl-diphenyl phosphates. A representative commercial triaryl phosphate supplied by FMC Corporation is available under the tradename "Durad 620B".

Similarly, suitable liquid alphaolefin oligomers (PAO) material for employment in accordance with the present invention can be selected from the class of saturated olefin oligomers generally obtained upon polymerization to low molecular weight products of linear alphaolefins. These oligomerization products are commercially available from various suppliers with typical oligomers comprising mixtures containing dimers, trimers, tetramers, pentamers and possibly even hexamers. These starting materials are further commonly classified according to approximate kinematic viscosity while exhibiting thermal and oxidation stability adequate for bearing operation at temperatures up to 250° C. and even greater. Representative liquid alphaolefin oligomers having pour points below about −50° C. are still further described along with methods for preparation in U.S. Pat. Nos. 3,763,244 and 3,780,128.

BRIEF DESCRIPTION OF THE DRAWING

The accompanying drawing is a graph providing friction force measurements for a particular lubrication means of the present invention.

DETAILED DESCRIPTION OF THE PREFERRED EMBODIMENTS

A mechanical test apparatus of the already known ball and rod fatigue test construction described in the aforementioned U.S. Pat. No. 5,163,757 reference specifically incorporated herein was employed to evaluate performance of a representative vapor-phase lubrication means according to the present invention. More particularly, the employed test apparatus featured three M50 molybdenum steel bearings of 0.5 inch diameter and positioned within a 4340 steel alloy cage for dynamic physical contact with a rotating 0.375 inch diameter rod of T15 steel connected to an electric motor for rotation at 3600 RPM. Said test apparatus further included conventional heating means enabling bearing operation at elevated temperatures of at least 500° C. while admitting an air mixture of the vaporized starting lubricant from its supply source to the rotating bearing contact region. Under the illustrated test conditions, a polymer deposit was visually observed to form on the bearing members with the present lubrication means.

The accompanying graph reports friction measurements for elevated temperature bearing operation in the above described manner while employing a starting lubricant blend containing approximately 85 volume percent of the liquid alphaolefin oligomer constituent with a pour point of about −50° C. with approximately 15 volume percent of the aforementioned Durad 620B triaryl phosphate ester being dissolved therein. Said starting lubricant blend was continuously applied to the operating bearing structure at a flow rate of approximately 2.5 milliliters per hour after vaporization by heating to approximately 550° F. and further combining the vaporized mixture with air flowing at a rate of approximately 2000 cubic centimeters per minute. A thrust load of approximately 3.34 giga Pascals in value was maintained on the bearing structure during the reported test measurements at a bearing operating temperature of approximately 600° F. As can be noted in the reported results, the test lubricant blend produced relatively low friction coefficients over a lengthy time duration of ninety hours while further exhibiting a surprising decrease in friction and wear as the test continued. It will also be apparent from these measurements that a broad commercial potential exists for the present lubrication means in several respects. For example, the present lubrication means have already been found suitable for elevated temperature bearing operation up to at least 500° C. Likewise, a temporary interruption of the present lubrication means during bearing operation at such elevated temperatures has been found not to produce immediate bearing failure under the aforesaid test conditions for interruption periods exceeding thirty minutes. A utilization of the present lubrication means in connection with such elevated temperature operation of bearing devices employing ceramic materials, such as silicon carbide and silicon nitride, has also been demonstrated. Ability to have the present lubrication means be utilized in the aforesaid manner when environmental temperatures fall to −60° C. and below understandably further provides a wide range of service temperatures.

It will be apparent from the foregoing description that broadly useful and novel means have been provided to continuously lubricate various type metal and/or ceramic bearing surfaces when operated under various atmospheric conditions at extremely elevated temperatures of at least 500° C. and higher. It is contemplated that such improved lubrication can likewise be obtained with a broad range of load bearing constructions in rolling and/or sliding contact other than above illustrated, however, to include both ball and roller bearing devices, as well as apparatus employing gears, cams, piston rings and like devices. Likewise it is contemplated that enhancement of resistance to bearing surface wear provided with the present lubrication means can possibly be further improved utilizing additional means for treatment of the bearing surfaces such as disclosed in the aforementioned U.S. Pat. Nos. 5,139,876 and 5,163,757 references specifically incorporated herein. Substituting still other metal and ceramic materials than herein described for construction of the bearing devices could also desirably lower lubricant levels for the present lubrication means while possibly further decreasing bearing surface wear at these elevated temperatures. Still other aryl phosphate esters and liquid alphaolefin oligomers than herein expressly disclosed may possibly further exist for combination to provide the presently improved lubrication means. Consequently, it is intended to limit the present invention only by the scope of the appended claims.

What we claim as new and desire to secure by Letters Patent of the United States is:

1. A method of reducing mechanical wear between a pair of moving bearing surfaces constructed of a material selected from the group consisting of metals, ceramics and combinations thereof, said bearing surfaces being operated in dynamic physical contact at elevated temperatures up to at least 500° C. comprising:

(a) providing a blended mixture containing an aryl phosphate ester suspended in a liquid alphaolefin oligomer, (b) heating the blended mixture sufficiently to cause its vaporization, and (c) treating the bearing surfaces during operation at elevated temperatures of at least 300° C. with the vaporized blended mixture causing the vaporized aryl phosphate ester to polymerize in the vapor phase while in contact with the operating bearing surfaces and form a vapor-deposited adherent polymer lubricating coating in-situ on at least one of the treated bearing surfaces.

2. The method of claim 1 wherein the employed aryl phosphate ester is a triaryl phosphate ester.

3. The method of claim 2 wherein the employed aryl phosphate ester includes tertiarybutylphenyl phenyl phosphate.

4. The method of claim 1 wherein the bearing surfaces are constructed of a metal material.

5. The method of claim 1 wherein the bearing surfaces are constructed of a ceramic material.

6. The method of claim 1 wherein the bearing surfaces are constructed of a metal material and a ceramic material.

7. The method of claim 1 wherein an oxidizable metal source located in physical proximity to the bearing surfaces promotes polymerization of the vaporized aryl phosphate ester.

8. The method of claim 1 wherein the lubricating coating formed comprises a solid polymer at ambient conditions having a molecular weight of at least 30,000.

9. The method of claim 1 wherein the bearing surfaces are operated in air.

* * * * *